United States Patent [19]

Zimmer

[11] 3,942,438

[45] Mar. 9, 1976

[54] DYESTUFF APPLICATOR FOR SCREEN PRINTER

[76] Inventor: Peter Zimmer, Untere Sparchen 54, A 6330 Kufstein, Austria

[22] Filed: Feb. 13, 1974

[21] Appl. No.: 442,221

[30] Foreign Application Priority Data

Feb. 19, 1973 Austria ..... 1438/73

[52] U.S. Cl. ..... 101/119; 101/120

[51] Int. Cl.[2] ..... B41F 15/42; B41F 15/46

[58] Field of Search ..... 101/115, 116, 119, 120, 101/123, 129, 216, 212; 248/54 R, 55, 288, 358 R, 358 AA

[56] References Cited

UNITED STATES PATENTS

| | | | |
|---|---|---|---|
| 1,330,793 | 2/1920 | Friess | 101/216 UX |
| 2,578,413 | 12/1951 | Ford | 101/216 |
| 3,647,525 | 3/1972 | Dahlgren | 101/148 X |
| 3,718,086 | 2/1973 | Vertegaal | 101/120 X |

*Primary Examiner*—Edgar S. Burr
*Assistant Examiner*—R. E. Suter
*Attorney, Agent, or Firm*—Ernest G. Montague; Karl F. Ross; Herbert Dubno

[57] ABSTRACT

A dyestuff applicator inside a cylindrical printing screen comprises an elongate hollow body with a bottom portion contacting the inner screen surface and an outlet for ink supplied to that body through one of two tubular extremities thereof, these extremities being clamped in respective mountings with their axes disaligned to generate stresses counteracting the forces of gravity and friction which tend to deform the outlet from its linear shape. Each end mounting may comprise a pair of axially spaced rigid rings with toroidal inner surfaces, of adjustable relative elevation, or an elongate sleeve cradled in a vertically adjustable bearing frame in which the sleeve can be immobilized at a desired inclination to the horizontal and the vertical. The sleeve may have a yieldable lining or be braced by damping springs and dashpots against oscillations of the applicator body.

12 Claims, 5 Drawing Figures

DYESTUFF APPLICATOR FOR SCREEN PRINTER

FIELD OF THE INVENTION

My present invention relates to a dyestuff applicator for a printing machine, more particular a screen printer in which an apertured printing screen overlies a substrate to be imprinted and is movable together with that substrate in a predetermined direction.

BACKGROUND OF THE INVENTION

As described for example in my copending application Ser. No. 426,909 filed 20 Dec. 1973, such a dyestuff applicator has a stationary, elongate hollow body extending axially within the screen, this body having an inlet for the admission of liquid dyestuff (generally through an extremity of the body projecting axially beyond the screen) and further having a body portion contacting the inner screen surface.

With screens of large width, requiring dyestuff applicators of considerable length, the weight of the liquid-filled applicator body tends to cause same to sag so that greater contact pressure is exerted upon a middle region of the screen surface than upon its end regions. A certain deviation from parallelism with the screen axis also results from frictional forces effective along the contact area between the screen and the bottom portion of the applicator.

OBJECTS OF THE INVENTION

The general object of my present invention, therefore, is to provide an improved support structure for the axially extending extremities of such an applicator body designed to maintain the linearity necessary for even printing.

Another object is to provide means in such a mounting structure for minimizing friction-induced oscillations to which the applicator may be subjected in operation.

SUMMARY OF THE INVENTION

In accordance with my present invention, the stationary applicator body is provided with independently adjustable mountings for its extremities disposed alongside the screen on a supporting frame, each of these mountings comprising holding means engaging a respective extremity, and as an elongate sleeve held in a bearing member, and fastening means for fixedly retaining the holding means in a position of inclination of the engaged extremity with reference to the screen axis. I further provide cushioning means, such as a deformable sleeve lining or damper between the sleeve and an extension of its bearing member, for absorbing oscillations to which the engaged extremity may be subjected.

BRIEF DESCRIPTION OF THE DRAWING

The above and other features of my invention will now be described in detail with reference to the accompanying drawing in which.

SPECIFIC DESCRIPTION

Figure 1:
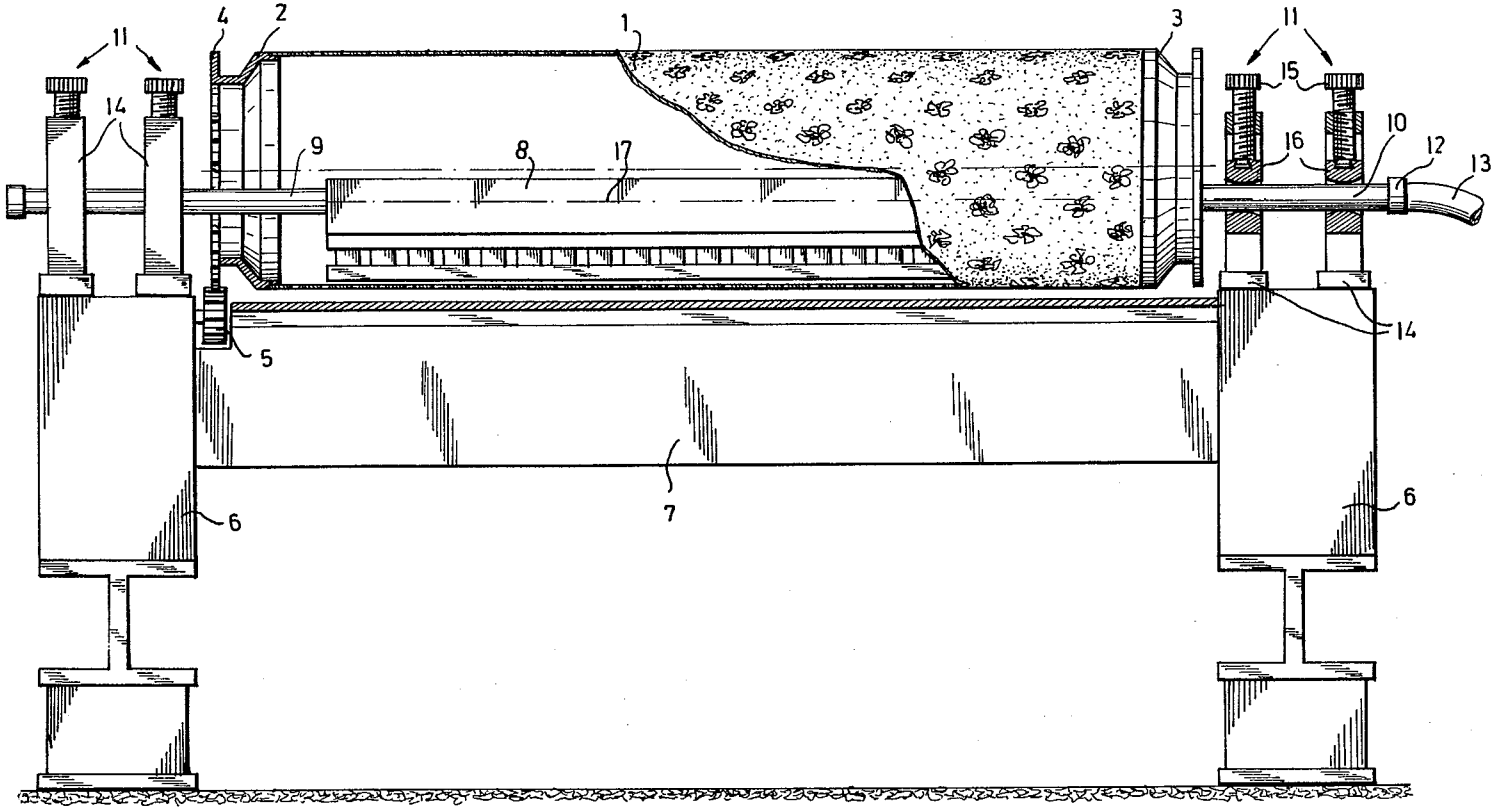
FIG. 1 is a side-elevational view (with parts broken away) of a printing screen provided with applicator mountings according to my invention.

In FIG. 1 I show a rotary screen 1 with two heads 2 and 3 at its ends. The head 2 bears a gear 4 which engages a pinion 5 set in rotation by a driving mechanism (not shown) in the machine frame 6. Below the rotary screen 1 there is a printing table 7 whose top supports a web-shaped substrate to be imprinted. Within the screen 1 there is located a box-shaped ink applicator 8 which in this case is closed on all sides except for an elongate bottom outlet in the form of a slot or a series of holes. The extremities 9 and 10 of the applicator body are designed as pipes and are supported in pairs of clamping blocks 11. The right-hand end 10 has an inlet coupling 12 connected to a supply conduit 13 which feeds printing ink from a nonillustrated pump into the applicator box 8. The blocks 11 comprise frames 14 in which mounting rings 16 can slide up and down under the control of screws 15. It can be seen that these mounting rings 16 have toroidal inner surfaces which are slightly convex toward the pipes 9, 10. If all rings 16 are placed with their axes aligned and at the same level, the axis 17 of the applicator box 8 will also be on this level and extend along a straight line. On the other hand, if the rings 16 of the two inner blocks 11 closer to the screen heads 2, 3 are raised above the rings 16 of the outer blocks, then the axis 17 will be upwardly cambered to an extent depending on the difference in the height of the centers of the outer and inner rings 16. In this way the sagging of the box 8 under its own weight and that of its ink filling, which may be very substantial, can be virtually eliminated. The double support by the two pairs of blocks 11 on opposite sides of the screen considerably improves the linearity of the applicator box 8 even when the axes of the rings 16 are located at the same level and therefore aligned with one another. With such a mounting the lower part of the applicator, which bears upon the inner screen surface, makes uniform contact with the screen 1. It is thus possible to obtain an effective seal against leakage over the entire length of the applicator between its slot-shaped ink outlet and the screen surface so that the ink flows only through the screen apertures onto the underlying substrate. The end mounting shown in FIG. 1 can also be used with ink applicators wherein a doctor blade scrapes the screen surface, in order to insure uniform deformation of the scraping edge over the entire printing width.

Figure 2:
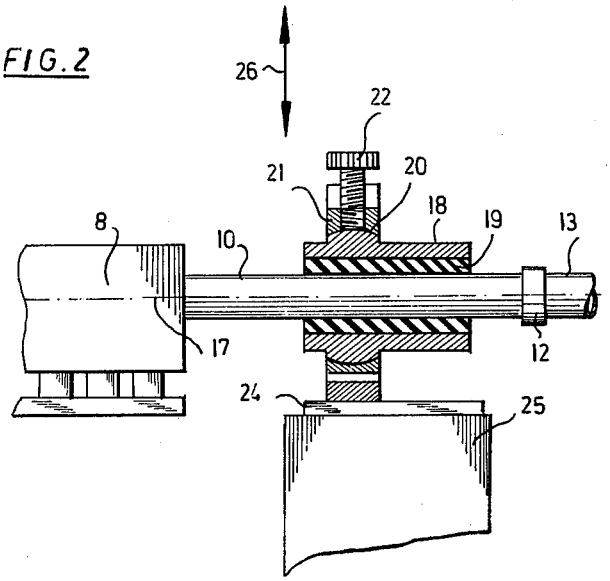
FIG. 2 is a fragmentary sectional elevation of the right-hand end of the applicator provided with another mounting according to my invention.
Figure 3:
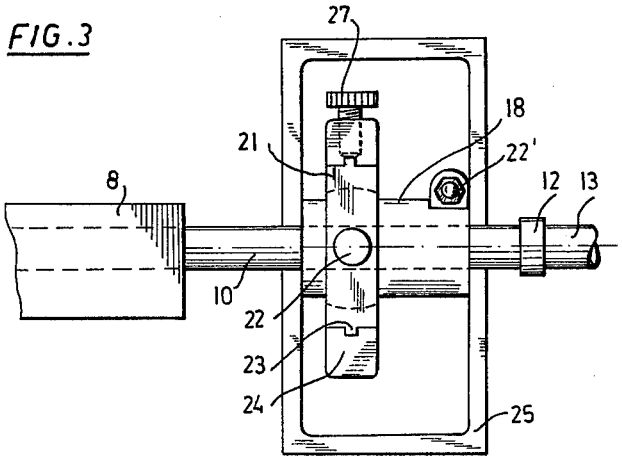
FIG. 3 is a top view of the assembly shown in FIG. 2.

In FIGS. 2 and 3, the same reference numbers have been used for similar parts as in FIG. 1. In this case the right-hand end 10 of the box 8 is shown held in a support which comprises a rigid sleeve 18 lined by a tubular rubber cushion 19. The sleeve 18 has a spherical outer portion 20 received in a corresponding recess in a bearing frame 21 and clamped therein by a screw 22. The axis of the sleeve 18 can thus assume any desired angular position and be secured in this angular position by means of the screw 22. The sleeve 18 is slitted in its longitudinal direction in a horizontal plane and, together with its rubber cushion 19, can be firmly pressed against the extremity 10 by means of a clamping screw 22'. The frame 21 is displaceable in a vertical direction 26 by means of ribs 23 guided in corresponding recesses of a holder 24, which is fastened rigidly to the machine frame 25, and can be held fast by a setscrew 27 at any desired height.

With the holder illustrated here it is also possible to give the axis 17 of the applicator box 8 any desired deformation in a vertical plane. Furthermore, the rubber cushion 19 acts as a damper upon the applicator when the latter is excited to torsional or flexural oscillations.

Figure 4:
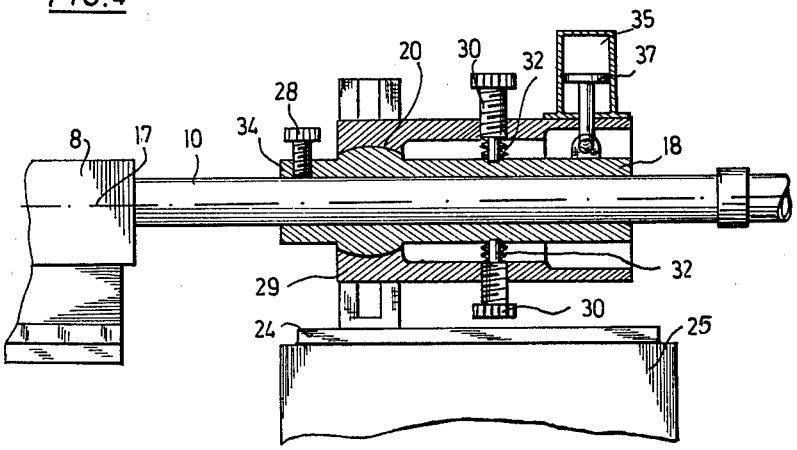
FIGS. 4 and 5 are views similar to those of FIGS. 2 and 3, respectively, illustrating a further modification.
Figure 5:
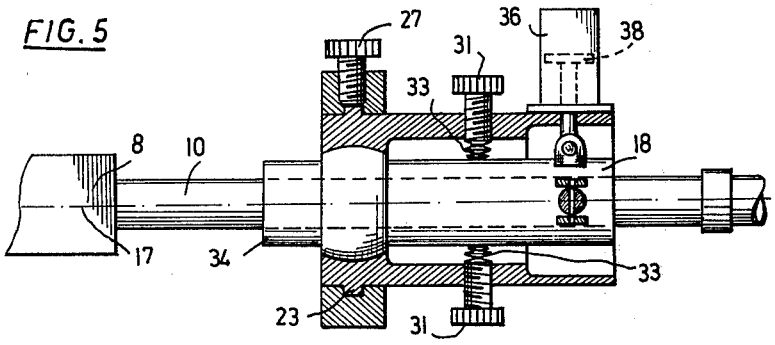

In FIGS. 4 and 5, where again the same reference numbers have been used for corresponding elements as in the preceding Figures, the right-hand extremity 10 of the applicator is in this case also clamped in a sleeve 18 which has a spherical protrusion 20. The clamping is effected via a screw 28; the spherical protrusion 20 rests in a corresponding recess of a guide sleeve 29, acting as a bearing member, which is displaceable in the vertical direction with the aid of ribs 23 sliding in corresponding grooves of the frame 24 which is fixed on the machine bed 25 and carries a setscrew 27. Sleeve 29 forms with the complementary spherical protrusion 20 a universal joint whereby the pipe 10 can be inclined from its illustrated position by means of setscrews 30 and Belleville springs 32 in a vertical plane and by means of setscrews 31 and Belleville springs 33 in a horizontal plane. It is thus again possible to impart to the axis 17 any desired deformation superimposed on the deformation to which it is subjected by the weight of the applicator or by the frictional forces acting between the latter and the screen, i.e. a horizontal bending moment in a direction opposing the frictional drag in addition to the vertical bending moment producing the aforementioned upward camber.

Furthermore, this illustrated mounting of the extremity 10 of the applicator also makes it possible to apply thereto a dynamic moment which has a component coming into existence upon a deformation of the springs 32 and 33 when the extremity 10 is placed in oscillation. A further component of this moment is imparted to the end 10 at its clamping point 34 by means of two dashpots 35, 36 becoming effective in mutually perpendicular axial planes (vertical and horizontal) when the pipe 10 oscillates about the center of the spherical surface 20. The oscillatable free end of sleeve 18 is articulated to pistons 37 and 38 of the horizontally and vertically disposed dashpots 35, 36 which are provided with bores for the throttled passage of a damping liquid as is well known per se. This results in a damping moment around the center of the spherical surface 20, acting upon the clamping point 34, whose amplitude and frequency depend on the amplitude and the frequency of the oscillator whereby this oscillation is attenuated. That attenuation can be optimized through suitable choice of the Belleville springs 32, 33 through which the setting means 30, 31 engage the sleeve 18 and therefore the extremity 10 in the aforementioned mutually perpendicular planes.

The present invention is not limited to the embodiments shown. Thus, for instance, in FIG. 2 the elastic rubber cushion 19 can be replaced by a cushion of so-called high-hysteresis rubber, which helps damp any oscillations of the applicator. A plurality of damper pistons can be provided in each plane; also, an anti-oscillation moment can be exerted by magnetic fields, weighting or similar loading means instead of hydraulic damping.

I claim:

1. In a printing machine, in combination:

a supporting frame;

a cylindrical printing screen rotatable on said frame about a horizontal axis;

a stationary applicator having an elongate hollow body extending axially within said screen, said body having an inlet for liquid dyestuff and further having a bottom portion contacting the inner screen surface, said bottom portion being provided with an elongate outlet for said dyestuff, said body terminating in a pair of extremities projecting generally axially from opposite sides of said screen;

independently adjustable mountings for said extremities disposed on said frame alongside said screen, each of said mountings comprising an elongate sleeve surrounding the respective extremity and fastening means for imparting a generally upward bending moment to said body by fixedly retaining each sleeve in a position of inclination of the engaged extremity with reference to the screen axis; and cushioning means in said mountings for absorbing oscillations of said extremities.

2. The combination defined in claim 1 wherein each of said mountings further comprises a bearing member for each sleeve enabling both vertical and horizontal inclination thereof relative to the screen axis.

3. The combination defined in claim 2 wherein each sleeve and bearing member are provided with complementary spherical surfaces.

4. The combination defined in claim 2 wherein said cushioning means comprises a deformable lining in each sleeve.

5. The combination defined in claim 2 wherein each sleeve is in rigid contact with the engaged extremity, said cushioning means comprising damping means anchored to each sleeve and to an extension of the respective bearing member.

6. The combination defined in claim 5 wherein each bearing member engages the respective sleeve at an end thereof proximal to said screen, said damping means comprising two stacks of Belleville springs bearing upon an intermediate portion of said sleeve and two dashpots bearing upon a free end of each sleeve in two mutually perpendicular axial planes.

7. The combination defined in claim 5 wherein said damping means comprises a horizontally disposed damper and a vertically disposed damper.

8. The combination defined in claim 7 wherein each of said dampers comprises a Belleville spring.

9. The combination defined in claim 7 wherein each of said dampers comprises a dashpot.

10. In a printing machine, in combination:

a supporting frame;

a cylindrical printing screen rotatable on said frame about a horizontal axis;

a stationary applicator having an elongate hollow body extending axially within said screen, said body having an inlet for liquid dyestuff and further having a bottom portion contacting the inner screen surface, said bottom portion being provided with an elongate outlet for said dyestuff, said body terminating in a pair of extremities projecting generally axially from opposite sides of said screen;

independently adjustable mountings for said extremities disposed on said frame alongside said screen, each of said mountings comprising a universal joint engaging the respective extremity on at least two axially spaced points and fastening means for fixedly retaining said extremity in a position of inclination of the engaged extremity with reference to the screen axis; and setting means on said frame engaging each of said extremities in two mutually perpendicular axial planes for imparting to said body a bending moment with an upward component counteracting the effect of gravity and a horizontal component counteracting the frictional drag exerted by said screen surface on said bottom portion.

11. The combination defined in claim 10 wherein said setting means comprises a set of adjustable screws engaging each of said extremities in said mutually perpendicular planes and damping springs interposed between said screws and said extremities.

12. The combination defined in claim 11, further comprising a pair of dashpots anchored to each of said extremities and to said frame in said mutually perpendicular planes.

* * * * *